United States Patent [19]

Brand

[11] Patent Number: 4,998,540

[45] Date of Patent: Mar. 12, 1991

[54] METHOD OF AND APPARATUS FOR ELIMINATING IRREGULARITIES FROM A STREAM OF FIBROUS MATERIAL

[75] Inventor: Peter Brand, Hamburg, Fed. Rep. of Germany

[73] Assignee: Körber AG, Kampchaussee, Fed. Rep. of Germany

[21] Appl. No.: 326,742

[22] Filed: Mar. 21, 1989

[30] Foreign Application Priority Data

Mar. 29, 1988 [DE] Fed. Rep. of Germany ..... 3810629

[51] Int. Cl.[5] ..... A24C 5/18; A24C 5/31

[52] U.S. Cl. ..... 131/110; 131/84.1; 131/84.3; 131/906; 131/909

[58] Field of Search ..... 131/906, 84.1, 84.4, 131/84.3

[56] References Cited

U.S. PATENT DOCUMENTS 4,185,646 1/1980 Heitmann et al. .
4,556,071 12/1985 Hoffmann ..... 131/906
4,564,027 1/1986 Heitmann et al. .

FOREIGN PATENT DOCUMENTS 0165080 12/1985 European Pat. Off. .
2729730 3/1978 Fed. Rep. of Germany .
0796246 6/1958 United Kingdom .
1164658 9/1969 United Kingdom .
2088693 6/1982 United Kingdom .

*Primary Examiner*—V. Millin
*Attorney, Agent, or Firm*—Peter K. Kontler

[57] ABSTRACT

A tobacco stream which is built at the underside of the lower reach of an endless foraminous belt conveyor is monitored by a detector which generates a signal in response to detection of excessive accumulations of tobacco in the stream. Such signals are used to interrupt the delivery of a tobacco flow to the belt conveyor, to arrest the device which supplies tobacco that forms the flow, to remove tobacco from the belt conveyor, and to restart the delivery of tobacco to the belt conveyor, to restart the tobacco supplying device, and to deactivate the tobacco removing device when the stream is removed from the belt conveyor. The interruption of delivery involves diversion of tobacco into a path which leads to a magazine. The tobacco removing device can include a valve which deactivates a suction chamber serving to attract tobacco to the belt conveyor, a mechanical tobacco remover and/or one or more nozzles which serve to blow compressed air against tobacco on the belt conveyor.

42 Claims, 3 Drawing Sheets

Fig. 5
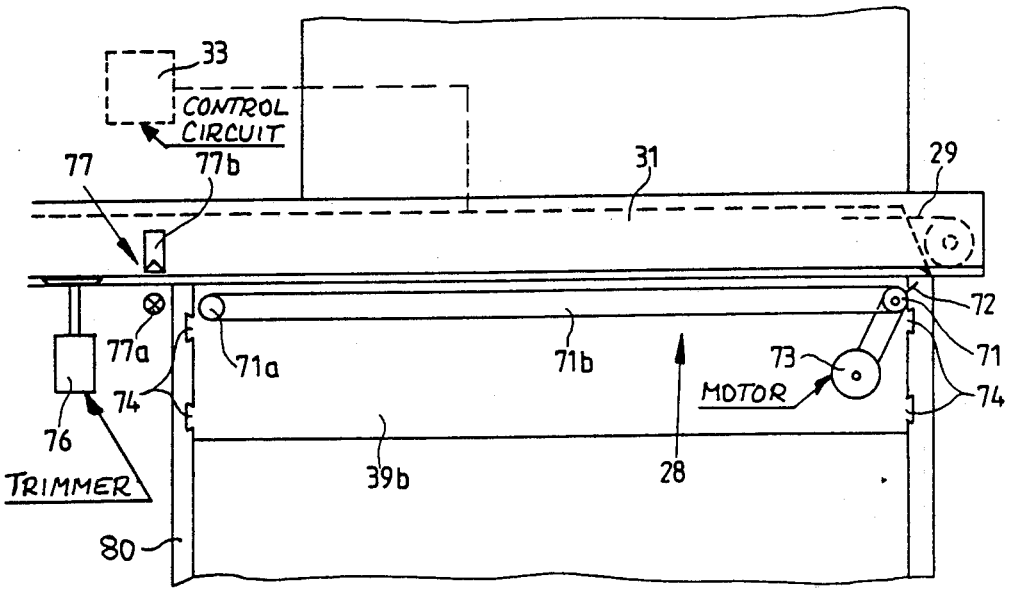
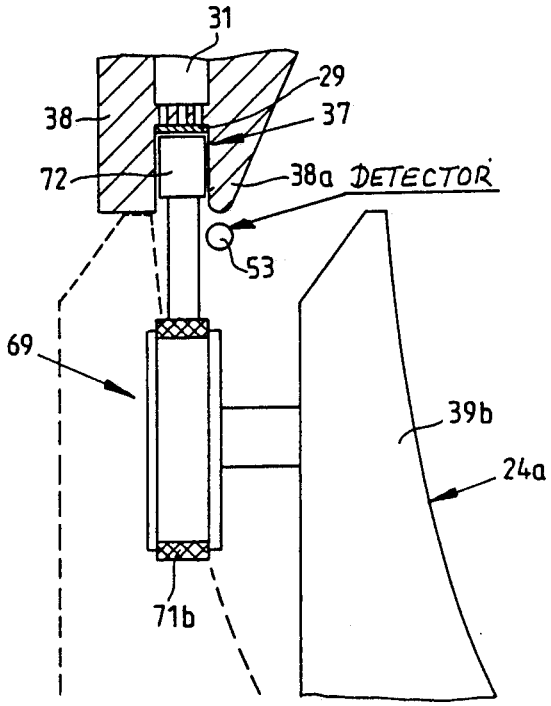
Fig. 4

METHOD OF AND APPARATUS FOR ELIMINATING IRREGULARITIES FROM A STREAM OF FIBROUS MATERIAL

BACKGROUND OF THE INVENTION

The invention relates to improvements in methods of and in apparatus for making a stream of fibrous material, such as a stream of comminuted tobacco leaves. More particularly, the invention relates to improvements in methods of and in apparatus for making a stream which consists of a fibrous material (particularly tobacco) and is obtained as a result of a conversion of a flow of loosened fibrous material during transfer of fibrous material from a first path into a second path.

It is known to make a rod-like filler of tobacco or other fibrous material of the tobacco processing industry in a machine wherein a so-called distributor or hopper draws fibrous material from a source of supply to form a relatively wide flow of loose fibers. The flow is advanced along a first path, and its leader is transferred into a second path wherein the transferred fibrous material forms a continuous stream. The stream is thereupon trimmed to remove the surplus of fibrous material, and the thus obtained rod-like filler is draped into a web of cigarette paper or the like to form a continuous rod which can be subdivided into sections of unit length or multiple unit length, e.g., into plain cigarettes, cigars or cigarillos or into filter rod sections of desired length. Reference may be had, for example, to commonly owned U.S. Pat. No. 4,185,644 to Heitmann et al. and to commonly owned U.S. Pat. No. 4,564,027 to Heitmann. As a rule, fibrous material which leaves the first path is transferred to the underside of the lower reach of an endless foraminous belt conveyor to which the fibrous material is attracted by suction and which advances the stream past the surplus removing means, through a wrapping mechanism wherein the trimmed stream is converted into a continuous rod by draping it into a web of wrapping material, and thereupon through a so-called cutoff which severs the leader of the rod at regular intervals to convert the rod into a file of rod-shaped articles of desired length. The flow of fibrous material can be delivered in a direction transversely of the direction of advancement of the growing and fully grown stream along the second path.

A drawback of presently known apparatus for making a continuous stream of fibrous material is that they cannot prevent so-called stream stoppers, namely excessive accumulations of fibrous material in or downstream of the stream building or growing zone (e.g., at the surplus removing station), from appreciably influencing the output. Such accumulations entail a clogging of the channel for the conveyor which defines the second path and necessitate immediate stoppage of the entire machine or production line for an interval of time which is required to remove the stopper or stoppers prior to restarting of the machine or production line. Each stoppage of a cigarette rod making machine results in huge losses in output since a modern cigarette maker is designed to turn out up to 10,000 plain cigarettes per minute.

OBJECTS OF THE INVENTION

An object of the invention is to provide a novel and improved method of making a stream of fibrous material, particularly comminuted tobacco leaves, in such a way that the development of so-called stoppers does not result in substantial losses in fibrous material and/or output.

Another object of the invention is to provide a novel and improved method of automatically detecting and eliminating irregularities in the path for the stream of fibrous material in a cigarette making or like machine of the tobacco processing industry.

A further object of the invention is to provide a method which renders it possible to shorten the intervals of idleness of a rod making machine for the purposes of eliminating excessive accumulations of fibrous material in the path for a stream of such material.

An additional object of the invention is to provide a method which renders it possible to automatically and immediately remove those accumulations of fibrous material which have caused irregularities in the formation and/or advancement of a stream of such material.

Still another object of the invention is to provide a novel and improved method of recovering fibrous material which would go to waste, or the quality of which would be affected, if irregularities in a stream of fibrous material were treated in accordance with heretofore known methods.

A further object of the invention is to provide a method which renders it possible to recover all fibrous material that has caused the development of an irregularity in a stream of such material in a machine or production line for the making of cigarettes or other rod-shaped articles of the tobacco processing industry.

An additional object of the invention is to provide a novel and improved apparatus for the practice of the above outlined method.

Another object of the invention is to provide the apparatus with novel and improved means for detecting and eliminating irregularities in a stream of comminuted tobacco leaves or other fibrous material of the tobacco processing industry.

A further object of the invention is to provide the apparatus with novel and improved means for advancing fibrous material to a stream building zone.

Another object of the invention is to provide the apparatus with novel and improved means for monitoring a stream of fibrous material for the purpose of detecting irregularities therein.

An additional object of the invention is to provide the apparatus with novel and improved means for removing fibrous material from one or more portions of the path for such material.

Another object of the invention is to provide the apparatus with novel and improved means for recirculating fibrous material in a cigarette rod making or like machine.

A further object of the invention is to provide the above outlined apparatus with means for treating the fibrous material gently, for recovering and reusing all fibrous material which must be removed from its path on detection of an irregularity, and for shortening the intervals of idleness of the machine or production line in which the apparatus is put to use.

SUMMARY OF THE INVENTION

One feature of the present invention resides in the provision of a method of making a stream of fibrous material, particularly a tobacco stream which can be converted into the filler of a cigarette rod. The improved method comprises the steps of advancing a flow of loose fibrous material along a first path, transferring successive increments of the advancing flow into a second path and conveying the transferred fibrous material along the second path in the form of a stream, monitoring the stream in the second path for the presence of irregularities (such as stoppage of the stream or excessive accumulations of fibrous material in the stream), and interrupting the transfer of fibrous material into the second path in response to detection of irregularities. The conveying step preferably includes transferring fibrous material into an endless conveyor (particularly to the underside of the lower reach of an endless foraminous belt conveyor to which fibrous material is attracted by suction). One of the first and second paths preferably extends substantially transversely of the other path.

The interrupting step can include admitting fibrous material from the first path into a third path which bypasses the second path.

The first path has an outlet which is adjacent a material-receiving (stream-building) portion of the second path during transfer of fibrous material into the second path, and the interrupting step can comprise changing the positions of the outlet and the material-receiving portion relative to each other so that fibrous material which issues from the outlet bypasses the material-receiving portion of the second path. The position changing step can include moving the outlet of the first path relative to the second path. Fibrous material which issues from the outlet on completion of the changing step is admitted into the aforementioned third path. The third path can lead into a storage facility for fibrous material, i.e., any fibrous material which leaves the first path on detection of an irregularity and is prevented from entering the the second path enters the storage facility from which it can be delivered into the first path to form the flow of fibrous material.

The method preferably further comprises the step of removing fibrous material from the material-receiving portion of or from the entire second path on detection of irregularities in the stream. Thus, the removing step can include removing fibrous material from the aforementioned conveyor which defines the second path; this ensures complete elimination of the irregularity, such as an excessive accumulation of fibrous material in the material-receiving and/or any other portion of the second path. The removing step can include mechanically removing fibrous material from the conveyor (e.g., by means of one or more brushes and/or one or more scrapers). Alternatively, the removing step can include pneumatically removing fibrous material from the conveyor (e.g., by directing one or more jets of compressed gaseous fluid against fibrous material in the second path). If the stream is pneumatically retained on the conveyor which defines the second path, the removing step can include interrupting the retaining step on detection of one or more irregularities in the stream. This enables the stream to leave the second path by gravity (if the stream is normally attracted to the underside of a foraminous conveyor) or facilitates the task of a mechanical or pneumatic removing device in removing fibrous material from the second path.

The method further comprises the step of resuming the transfer of fibrous material from the first path into the second path upon completed removal of fibrous material from the second path in response to detection of one or more irregularities in the stream.

Another feature of the invention resides in the provision of an apparatus for making a stream of fibrous material, particularly a tobacco stream which can be converted into the filler of a cigarette rod. The improved apparatus comprises means for advancing a flow of loose fibrous material along a first path, means for conveying successive increments of the flow along a second path in the form of a stream (the advancing means includes means for transferring successive increments of the flow into the second path), and interrupting means which is operative to interrupt the transfer of fibrous material from the first path into the second path. The interrupting means can include means for at least temporarily directing fibrous material from the first path into a third path, and such directing means can include means for changing the positions of the conveyor means and transferring means (of the advancing means) relative to each other. In accordance with a presently preferred embodiment of the interrupting means, the changing means of the interrupting means includes means for moving the transferring means substantially transversely of the second path to and from a predetermined position in which fibrous material leaving the first path is prevented from entering the second path. Such apparatus further comprises means (e.g., a magazine for fibrous material) for accepting fibrous material from the first path in the predetermined position of the transferring means. The moving means can include means for pivoting the transferring means to and from the predetermined position. Alternatively, the moving means can include means for imparting to the transferring means a translatory movement to and from the predetermined position.

The apparatus can further comprise means for monitoring the second path for irregularities of the stream and for generating signals in response to detection of irregularities. Such apparatus preferably also comprises control means for operating the interrupting means in response to signals from the monitoring means. The monitoring means can include means for monitoring the quantity of fibrous material in successive increments of the stream and for generating signals when the quantity of fibrous material exceeds a preselected value. The control means can operate the aforementioned means for moving the transferring means to and from a predetermined position in which fibrous material leaving the first path is caused to bypass the second path.

The conveying means preferably includes an endless conveyor and a channel for the conveyor. The channel is adjacent the transferring means and includes two walls or cheeks which flank the material-receiving portion of the second path. The transferring means is preferably arranged to transfer fibrous material into the channel in a direction toward one of the walls, and the aforementioned monitoring means is preferably arranged to monitor the second path for irregularities of the stream at the other wall of the channel. The monitoring means can include at least one photoelectronic transducer. If desired, the monitoring means can be installed in the other wall of the channel and can include at least one electric, electromagnetic and/or optical detector of irregularities. It is also possible to employ monitoring means which is designed to direct at least one beam of radiation across the second path in such direction that the absence of fibrous material in the second path or an excessive accumulation of fibrous material in the second path causes the generation of a signal which is used to interrupt the transfer of fibrous material into the second path.

The apparatus can further comprise cleaning means for effecting removal of fibrous material from the second path in response to signals from the monitoring means. Thus, signals from the monitoring means can initiate an interruption of transfer of fibrous material from the first path into the second path, diversion of fibrous material from the first path into a third path, and/or removal of fibrous material from the second path.

The interrupting means preferably comprises a support for the transferring means and means for moving the support between a first position in which the transferring means directs fibrous material from the first path into the second path, and a second position in which fibrous material leaving the first path bypasses the second path. The removing means is arranged to remove fibrous material from the second path in the second position of the support, and such removing means can be mounted directly on the support, preferably at that side of the support which faces away from the transferring means. The removing means can include means (e.g., one or more nozzles) for directing at least one jet of a compressed gaseous fluid into the second path. Such nozzle(s) can form integral part(s) of the support, the same as the transferring means.

Alternatively, the material removing means at the aforementioned side of the support can include a mechanical material removing device (e.g., a scraper and/or a brush), and means for moving the mechanical material removing device along the second path, particularly through the channel and along that portion of the endless conveyor which defines the second path (i.e., along the underside of the lower reach of the aforementioned endless foraminous conveyor if the latter is designed to attract fibrous material to the underside of its lower reach).

The apparatus can further comprise a magazine for fibrous material, and the aforementioned interrupting means can include means for at least temporarily directing fibrous material from the first path into the magazine. Such directing means can include at least one conveyor which serves to transport fibrous material into the magazine, and means for changing the positions of the transferring means and the conveyor means relatively to each other so that the transferring means delivers or effects the delivery of fibrous material from the first path to the at least one conveyor which transports such fibrous material into the magazine.

The apparatus can further comprise means for supplying fibrous material into or toward the first path (e.g., from the magazine to the flow advancing means), drive means for the supplying means, and control means for arresting the drive means in response to signals from the monitoring means, i.e., in response to detection of an irregularity in the stream. The control means can include means for automatically restarting the drive means upon removal or expulsion of fibrous material from the second path to thus reduce the interval of interruption of the making of the stream to a minimum. The supplying means can comprise a carded wheel which withdraws fibrous material from the aforementioned magazine or from a relatively small reservoir (e.g., an upright duct) disposed between the magazine and the carded wheel, and a picker roller which expels fibrous material from the carding of the wheel and propels the expelled fibrous material toward or into the first path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a similar view of a fourth apparatus; and

FIG. 5 is a smaller-scale view of the fourth apparatus as seen from the left-hand side of FIG. 4.

DESCRIPTION OF PREFERRED EMBODIMENTS

Figure 1:
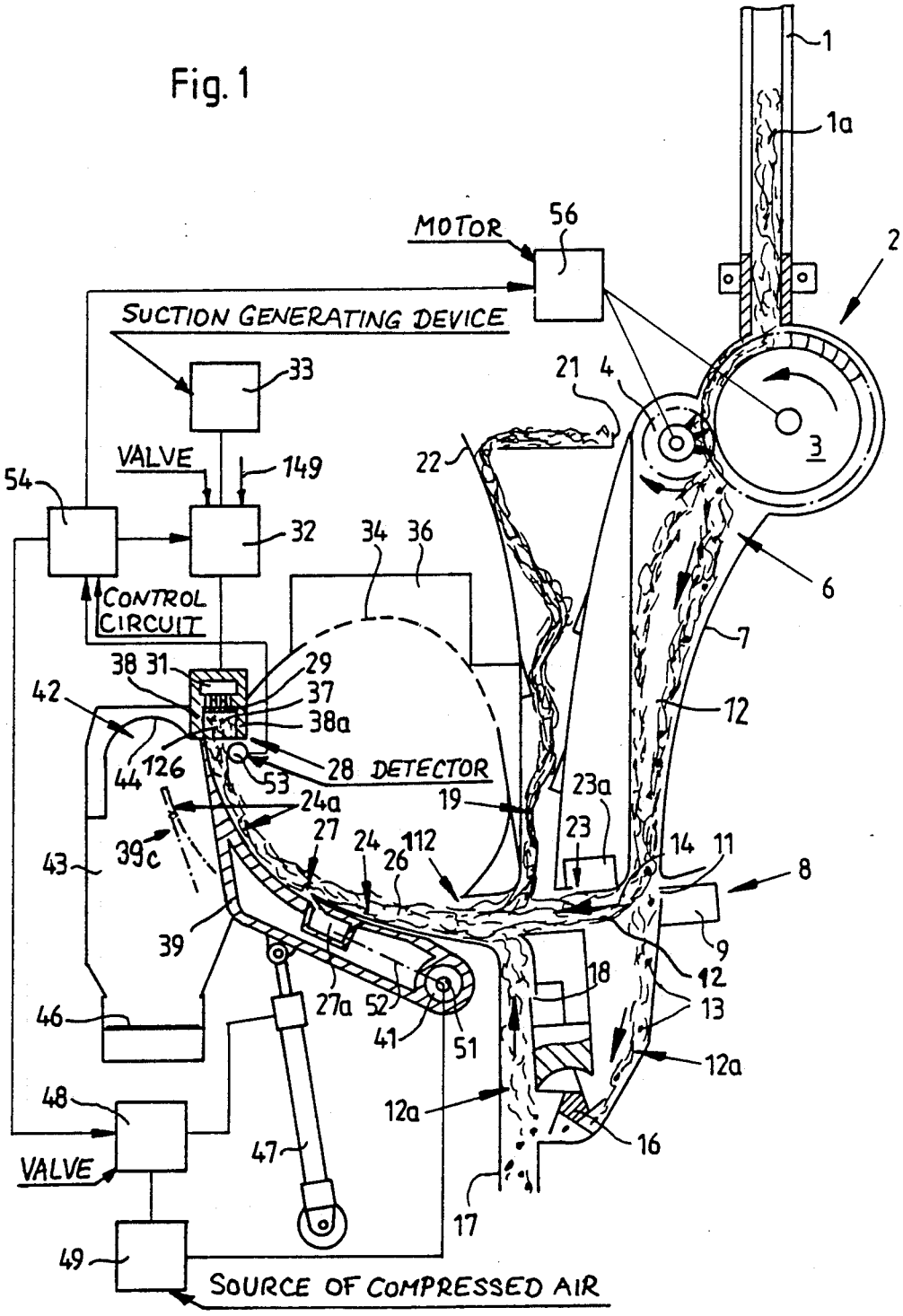
FIG. 1 is a fragmentary schematic partly elevational and partly vertical sectional view of an apparatus which embodies one form of the invention.

FIG. 1 shows a portion of an apparatus which is designed to make a continuous cigarette rod. The apparatus comprises a distributor (also called hopper) which includes a magazine (such as the magazine 1 shown in FIG. 1 of commonly owned U.S. Pat. No. 4,185,644 to Heitmann et al.) constituting a source of supply of fibrous material (e.g., comminuted tobacco leaves) and an elevator conveyor (such as the elevator conveyor 6 in FIG. 1 of Heitmann et al.) serving to deliver fibrous material into the upper end of a relatively small magazine here shown as an upright duct 1 so that the delivered fibrous material forms a column la at a level above a carded wheel 3 forming part of a material withdrawing and supplying device 2. The latter further comprises a rapidly driven picker roller 4 which expels fibrous material from the carding of the wheel 3 and propels the resulting shower 6 of fibrous material into a downwardly extending and downwardly tapering funnel 7. Reference may be had to the aforementioned Pat. No. 4,185,644 to Heitmann et al., to the aforementioned commonly owned U.S. Pat. No. 4,564,027 to Heitmann, to commonly owned German Pat. No. 27 29 730 as well as to numerous additional commonly owned U.S. and foreign patents and patent applications of the assignee of the present application.

The funnel 7 cooperates with an accelerating device 8 including a plenum chamber 9 which supplies compressed gaseous fluid (normally air) to one or more nozzles 11 serving as a means for discharging one or more streams or jets of classifying fluid (hereinafter referred to as air) across the descending shower 6 of fibrous material in the funnel 7. This results in the formation of a relatively wide flow 26 of loosened fibrous material which advances along an elongated first path in the direction of arrow 14. The classifying stream or streams entrain lighter fibrous material 12 (such as shreds of tobacco leaf laminae) from the funnel 7 and along the upper side of a concavo-convex advancing member 24, e.g., a sheet metal plate which has a concave upper side and a convex underside. Heavier fibrous material 13 (such as fragments of tobacco ribs) descends across the classifying air stream of streams issuing from the nozzle or nozzles 11 and normally entrains a certain percentage of lighter fibrous material (shown at 12*a*). The mixture of heavier fibrous material 13 and lighter fibrous material 12*a* descends toward and passes through a rotary cellular gate 16 to enter a vertical duct 17 serving for evacuation of heavier fibrous material 13 from the distributor. Lighter fibrous material 12*a* is segregated from heavier fibrous material 13 by rising in the duct 17 under the action of one or more jets of compressed air issuing from one or more nozzles 18 which discharge into the duct 17 at a level above the gate 16 to produce an injector effect which entails an upward movement of fibrous material 12*a* into the flow 26 of fibrous material 12 advancing in the direction of arrow 14. The junction of the two partial flows which together form the flow 26 at the upper side of the flow advancing member 24 is shown at 112. The flow 26 further receives lightweight fibrous material 19 by way of a downwardly tapering funnel 22 which, in turn, receives fibrous material from a vibratory trough-shaped conveyor 21. The latter delivers to the funnel 22 surplus fibrous material which is removed from a continuous stream 126 so that the thus trimmed stream forms a rod-like filler which is ready to be draped into a web of cigarette paper or other suitable material and to form therewith a continuous rod which is ready to be subdivided into rod-shaped articles of unit length or multiple unit length, e.g., into plain cigarettes of unit length or multiple unit length if the fibrous material 12+12*a*+19 constitutes or contains comminuted tobacco leaf laminae, comminuted substitute tobacco or comminuted sheets of reconstituted tobacco. Fibrous material 19 forms a shower which descends onto fibrous material 12+12*a* at the junction 112 above the upper end of the duct 17 for delivery of fibrous material 12*a*.

The distributor of FIG. 1 further comprises one or more additional nozzles 23 receiving compressed air from a plenum chamber 23*a* and serving to discharge one or more jets of compressed air in (or substantially in) the direction of arrow 14 so that the fibrous material 12 advances toward and beyond the junction 112 and along the concave upper side of the advancing member 24. The flow 26 can be said to constitute a relatively wide carpet of loosened fibrous material (12+12*a*+19) which advances along the first path toward and along a mobile upper section 24*a* forming a foremost part of the advancing member 24 can constituting a means for transferring successive increments of the flow 26 into a second path extending along the underside of a conveying means here shown as including an endless foraminous belt conveyor 29 trained over several pulleys, for example, in a manner as shown in FIG. 5 and in FIG. 5 of U.S. Pat. No. 4,185,644 to Heitmann et al. The flow 26 is caused to advance very close to the concave upper side of the advancing member 24 and can be accelerated at least once more by one or more nozzles 27 receiving compressed air from a plenum chamber 27*a* at the locus where the concave upper side of the section 24*a* extends upwardly and beyond the concave upper side of the main portion of section of the advancing member 24. One or more nozzles can be provided in the section 24*a* to even more reliably ensure that the flow 26 invariably advances along and beyond the concave upper side of the section 24*a* when the apparatus of FIG. 1 is in use to make a stream 126 of fibrous material.

The second path (which is substantially horizontal and is adjacent the underside of the lower reach of the endless foraminous belt conveyor 29) extends transversely of the first path which is defined by the advancing member 24 and its section 24*a*. Such second path receives successive increments of the flow 26 of spread-out and loosened fibrous material at a material-receiving or stream building station 28 where the flow 26 is converted into a normally continuous stream 126 containing a surplus of fibrous material, i.e., more material than is necessary per unit length of the rod-shaped filler in a cigarette rod. The stream 126 is attracted to the underside of the lower reach of the conveyor 29 (which is driven to advance in a direction at right angles to the plane of FIG. 1) by a suction chamber 31 which has a perforated bottom wall adjacent the upper side of the lower reach of the conveyor 29 and has an outlet connected to the intake of a suction generating device 33 (e.g., a pump or a fan) by an adjustable valve 32.

The surplus of compressed air (such compressed air is delivered by the nozzles 11, 18, 23 and 27) enters an expansion chamber 36 through the interstices of a sieve 34.

The lower reach of the conveyor 29 advances between the walls or cheeks 38, 38*a* of a tobacco channel 37 which cooperates with the lower reach of the conveyor 29 to define the aforementioned second path wherein the stream 126 advances past a surplus removing device or trimmer (such as that shown at 76 in FIG. 5 or at 79 in FIG. 5 of U.S. Pat. No. 4,185,644 to Heitmann et al.) and thereupon into a wrapping mechanism (also shown in FIG. 5 of Heitmann et al.) to be draped into a web of cigarette paper or other suitable wrapping material prior to being subdivided into rod-shaped articles of unit length or multiple unit length.

When it is caused or permitted to assume its normal or operative position, the mobile section (transferring means) 24*a* of the advancing member 24 is oriented in such a way that it directs successive increments of the flow 26 toward the inner side of the wall 38 with a preferably smooth and gap-free transition from the concave upper side of the section 24*a* to the inner side of the wall 38.

In accordance with a feature of the invention, the apparatus of FIG. 1 further comprises a device which serves to interrupt the transfer of fibrous material from the first path into the second path when the stream 126 contains excessive accumulations of fibrous material and/or when the stream 126 is arrested, e.g., as a result of clogging of the channel 37 at the material-receiving or stream building station 28. The interrupting means comprises a hollow support 39 which can be or is integral with the section 24*a* of the advancing member 24, and a fluid-operated motor 47 constituting a means for moving the support 39 and motor 47 constituting a means for moving positions which are shown in FIG. 1 by solid lines and inoperative (predetermined) positions. The inoperative or predetermined position of the support 39 is shown by phantom lines, as at 39*c*. Thus, the motor 47 can cooperate with the support 39 to move the outlet of the first path between a position in which successive increments of the flow 26 enter the second path (at 28) to form the stream 126, and a position in which the outlet of the first path bypasses the second path and admits successive increments of the flow 26 into a third path defined by a concave surface 44 at the upper end of a material accepting device 43 serving to deliver the thus gathered fibrous material into the aforementioned magazine (shown in FIG. 1 of Heitmann et al.).

In the embodiment of FIG. 1, the support 39 and the section 24*a* are pivotable about the horizontal axis of a hollow shaft 41 which is mounted in the frame of a rod making machine, such as a cigarette maker of the type known as PROTOS which is made and distributed by the assignee of the present application, The inlet 42 of the third path which is defined by the concave surface 44 of the material accepting device 43 is sealed by the section 24*a* and support 39 when the latter is caused to assume the solid-line position of FIG. 1 so that successive increments of the flow 26 are then compelled to enter the adjacent portion of the second path at the material-receiving or stream growing station 28. However, the inlet 42 is automatically exposed and automatically receives fibrous material of the flow 26 if the flow continues to advance along the concave upper side of the section 24*a* when the support 39 is caused or permitted to assume the position 39*c* of FIG. 1.

The motor 47 receives a compressed gaseous fluid (normally air) from a source 49 by way of an adjustable valve 48 which can receive signals from a control circuit 54. The source 49 further serves to deliver compressed air to the plenum chamber 27*a* by way of an axial bore or hole 51 in the shaft 41 and a conduit 52 (indicated by a phantom line) which connects the bore or hole 51 with the chamber 27*a*. If the motor 47 is a hydraulic motor, the source 49 merely delivers compressed gas to the plenum chamber 27*a* and/or to the plenum chamber 9 and/or 23*a* and/or to the plenum chamber for the nozzle or nozzles 18.

The apparatus of FIG. 1 further comprises means for monitoring the stream 126 for the presence or absence of irregularities, such as stoppage of the stream and/or the accumulation of so-called stream stoppers, namely excessive accumulations of fibrous material along the underside of the lower reach of the conveyor 29. Stream stoppers are likely to develop at the stream building station 28 and/or in the region of the aforementioned stream trimming or equalizing device which is located downstream of the station 28 and preferably comprises one or more rotary trimming knives which remove the surplus. Such surplus is delivered to the vibratory conveyor 21 which delivers the surplus into the funnel 22 wherein the surplus forms the shower 19 descending onto fibrous material 12 and 12*a* at the junction 112. The monitoring means comprises an optical detector 53 having a source of radiation and a photoelectronic transducer which transmits to the control circuit 54 a signal whenever the accumulation of fibrous material at the wall 38*a* of the channel 37 interrupts the beam or beams of radiation (e.g., visible light) between the radiation source and the transducer, i.e., whenever the height of the stream 126 reaches or exceeds a maximum permissible height such as indicates that the channel 37 is clogged and the forward movement of the stream 126 (in a direction at right angles to the plane of FIG. 1) is prevented, or that the stream 126 is slowed down to less than the speed of the lower reach of the conveyor 29.

When the apparatus of FIG. 1 (i.e., the cigarette rod making machine which embodies such apparatus) operates properly, the support 39 is maintained in the solid-line position of FIG. 1 so that the concave upper side of the section 24*a* (transferring means) of the advancing member 24 directs successive increments of the flow 26 of loosened fibrous material into the second path at the stream building or material-receiving station 28. The thus transferred fibrous material forms the stream 126 which advances with the lower reach of the conveyor 29 past the trimming device, wrapping mechanism and cutoff to be converted into a rod-like filler, thereupon into a wrapped rod and ultimately into a file of rod-shaped articles of the tobacco processing industry.

If a portion of the stream 126 grows into a stopper (i.e., into an excessive accumulation of fibrous material), this normally takes place at the stream forming station 28, i.e., between the walls 38 and 38*a* of the channel 37. The excessive accumulation of fibrous material then prevents the beam or beams of radiation from reaching the photoelectronic transducer of the monitoring means 53 so that the transducer generates a signal which is transmitted to the input of the control circuit 54. One output of the control circuit 54 then transmits a signal to the valve 48 which causes the motor 47 to pivot the support 39 to the phantom-line position 39*c* in which the flow 26 is caused to enter the third path (i.e., to bypass the second path) by advancing along the concave surface 44 and into the material accepting device 43 by way of the then exposed inlet 42. The thus diverted fibrous material descends onto a conveyor 46 at the bottom of the material accepting device 43 to be returned into the aforementioned magazine for the making of a fresh flow 26.

A second output of the control circuit 54 simultaneously transmits a signal to the valve 32 which seals the outlet of the suction chamber 31 from the suction generating device 33 so that fibrous material which forms the stream 126 at the underside of the lower reach of the conveyor 29 is no longer attracted to this conveyor and can descend by gravity onto the upper side of the section 24*a* (in the phantom-line position 39*c* of the support 39) so that the material of the thus destroyed stream 126 (including the stopper) is admitted into the material accepting device 43 and is returned to the magazine by way of the conveyor 46. At such time, the valve 32 can be caused to admit into the suction chamber 31 a stream of compressed air from the source 49 (note the conduit 149 in FIG. 1) to promote rapid expulsion of fibrous material from the channel 37 and from the remaining space at the underside of the lower reach of the conveyor 29. The connection or conduit 149 assists the force of gravity to practically instantaneously remove fibrous material from the second path so that the control circuit 54 can reset the valves 48 and 32 in order to initiate a resumption of delivery of successive increments of the flow 126 into the stream building zone 28 as a result of return movement of the support 39 to its solid-line position as as a result of reestablishment of a connection between the suction chamber 31 and the suction generating device 33 (simultaneously with sealing of the connection 149 between the source 49 of compressed air and the suction chamber 31).

FIG. 1 further shows that the control circuit 54 has a third output which is connected with a drive (e.g., a motor) 56 for the carded wheel 3 and picker roller 4 of the material withdrawing and supplying device 2. The drive 56 is arrested in response to pivoting of the support 39 to the position 39*c* so that the distributor of FIG. 1 interrupts the formation of the flow 26 of the interval of time which is required to divert the flow 26 into the material accepting device 43 and to remove the stream 126 from the second path. This entails a very gentle treatment of fibrous material because the quantity of fibrous material which must be recirculated through the device 43 and through the magazine is reduced to a minimum.

It will be noted that the apparatus of FIG. 1 can automatically detect excessive accumulations of fibrous material in the second path and can automatically eliminate such accumulations preparatory to restarting of the drive 56 for renewed making of a satisfactory stream.

Figure 2:
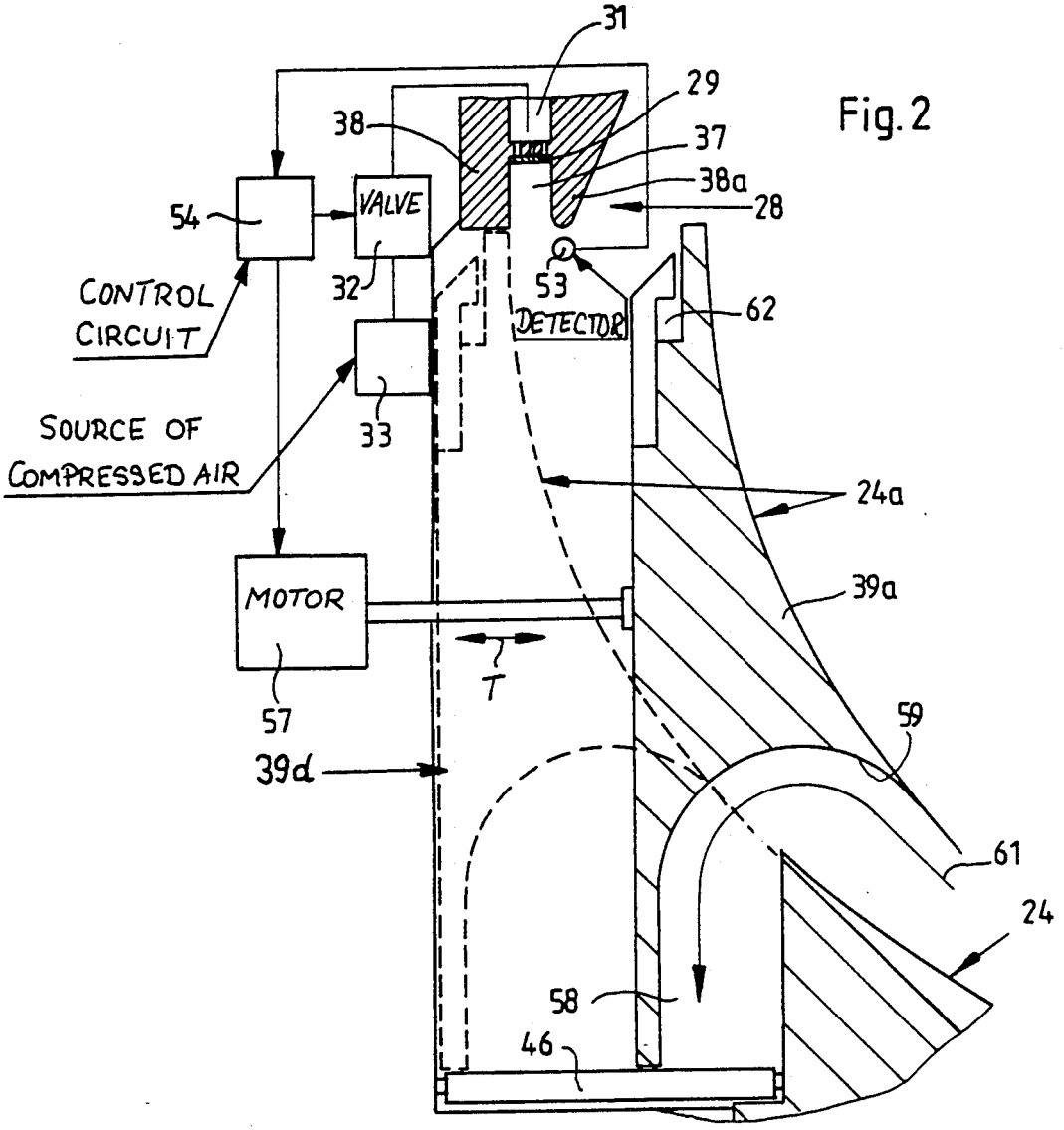
FIG. 2 is an enlarged view of a detail in a modified apparatus.
Figure 3:
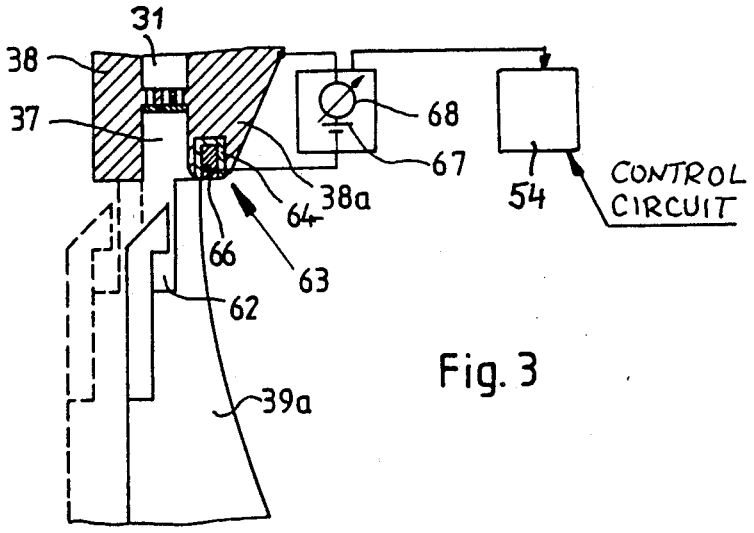
FIG. 3 illustrates a detail of an apparatus which constitutes a modification of the apparatus of FIGS. 1 or 2.

FIG. 2 shows a portion of a modified apparatus wherein all such parts which are identical with or clearly analogous to corresponding parts of the apparatus of FIG. 1 are denoted by similar reference characters (this also applies for the embodiments of FIG. 3 and FIGS. 4–5). The support 39*a* which is used in the apparatus of FIG. 2 to carry the topmost section (transferring means) 24*a* of the advancing member 24 is mounted for translatory movement in directions which are indicated by double-headed arrow T. This support 39*a* can be moved between a broken-line position 39*d* in which the section 24*a* is operative to direct successive increments of the flow 26 (not shown in FIG. 2) against the inner side of the wall 38 and a solid-line position in which the section 24*a* exposes the inlet of a channel 58 defining a third path indicated by arrow 61 so that successive increments of the flow cannot reach the section 24*a* but are diverted into the third path and onto the conveyor 46 at a level below the section 24*a*. The means for imparting a translatory movement to the support 39*a* and section 24*a* comprises a drive 57 which receives signals from the control circuit 54 to shift the section 24*a* to the solid-line position of FIG. 2 as soon as the monitoring device 53 detects an irregularity in the stream (not shown) in the channel 37, i.e., at the underside of the lower reach of the conveyor 29. Successive increments of the flow of fibrous material then strike against and are deflected by the concave surface 59 at the upper end of the channel 58 to descend onto the conveyor 46 which returns them into the magazine of the distributor.

Detection of a stopper or another irregularity in the stream results in transmission of a signal from the control circuit 54 to the valve 32 which seals the outlet of the suction chamber 31 from the intake of the suction generating device 33 so that the stream can leave the second path by gravity to descend directly onto the left-hand portion of the conveyor 46 and to be returned into the magazine.

The apparatus which embodies the structure of FIG. 2 further comprises a cleaning device 62 constituting a means for pneumatically removing fibrous material in response to movement of the support 39*a* to the solid-line position, i.e., in response to diversion of the flow into the channel 58. The removing means is an elongated nozzle 62 having a slit-shaped orifice at that side of the support 39*a* which faces away from the concave surface of the section 24*a*. The nozzle 62 is connected with the source 49 of compressed air (not shown in FIG. 2) in automatic response to shifting of the support 39*a* to the solid-line position of FIG. 2 so that the jet or jets of compressed air then issuing from the nozzle 62 act upon fibrous material at the underside of the lower reach of the conveyor 29 to effect rapid removal of the stream of fibrous material from the second path.

FIG. 3 shows a modification of the apparatus of FIG. 2. The operative position of the support 39*a* is again shown by phantom lines. When in the inoperative position (shown in FIG. 3 by solid lines), the support 39*a* maintains the nozzle 62 of the cleaning means directly beneath the channel 37 for the stream of fibrous material. The channel 58 (not shown in FIG. 3) is prevented from receiving fibrous material of the flow in the operative (broken-line) position of the support 39*a* which is shown in FIG. 3, the same as the channel 58 of FIG. 2.

The single nozzle 62 of FIGS. 2 or 3 can be replaced with a set of two or more properly distributed and oriented nozzles to even further enhance the cleaning or removing action by rapidly and completely expelling fibrous material from the second path at the underside of the lower reach of the conveyor 29. If the cleaning means comprises two or more nozzles 62 or otherwise configured nozzles, such nozzles can be spaced apart from each other in the longitudinal direction of the second path. It has been found that the cleaning action of one or more nozzles can be enhanced by orienting their preferably slit-shaped orifices in such a way that they are inclined with reference to the longitudinal direction of the second path, i.e., with reference to the direction of advancement of fibrous material with the lower reach of the conveyor 29.

FIG. 3 further shows a modified monitoring device 63 which is built directly into the wall 38*a* of the channel 37. The monitoring device 63 includes an electrically operated ohmic sensor having a conductor in the form of a metallic strip or bar 66 which is electrically separated from the wall 38*a* by an insulating layer 64. The conductor 66 is connected to the wall 38*a* (the latter is made of metal) by way of an energy source 67 and an ammeter 68. If the stream in the channel 37 contains an excessive accumulation of fibrous material, such material fills the channel 37 adjacent the inner side of the wall 38*a*, and this entails a change of resistance across the insulating layer 64. The ammeter 68 generates a signal which is transmitted to the control circuit 54. The latter then causes the drive 57 to shift the support 39*a* to the solid-line position in a manner as described with reference to FIG. 2. The control circuit 54 also causes the valve 32 to seal the suction chamber 31 from the suction generating device, and the drive 56 to arrest the wheel 3 and picker roller 2 of the material withdrawing and supplying device 2 in a manner as described with reference to FIGS. 1 and 2.

The monitoring device 63 of FIG. 3 can be replaced with any other suitable electrically operated, electromagnetic or optical monitoring device without departing from the spirit of the invention. Such monitoring device or devices may but need not be integrated into the wall 38*a* of the channel 37.

FIGS. 4 and 5 show a portion of a further apparatus which is provided with means for mechanically removing fibrous material from the second path at the underside of the lower reach of the conveyor 29. That side of the support 39*b* for the section 24*a* of the material advancing device which faces away from the concave surface of the section 24*a* is provided with a holder 69 in the form of an elongated carrier of two pulleys or sprocket wheels 71, 71*a*. An endless belt or chain conveyor 71*b* is trained over the members 71, 71*a* and is provided with a scraper 72 which can move along the underside of the lower reach of the conveyor 29 to remove the stream of fibrous material from the second path in response to starting of a motor 73 for the conveyor 71*b*. The motor 73 is connected to the control circuit 54 (not shown in FIGS. 4 and 5) to be started and to move the scraper 72 from a predetermined starting position when a monitoring device 77 detects a disturbance in the stream of fibrous material, e.g., a stopper in the channel 37. The scraper 72 can be replaced with one or more compressed-air nozzles, one or more brushes or any other suitable mechanical or other material removing or path cleaning elements.

The monitoring device 77 includes a radiation source 77a which is located at one side of the second path and an optoelectronic transducer 77b at the other side of the second path opposite the radiation source 77a. The intensity of radiation which penetrates through the stream of fibrous material at the underside of the lower reach of the conveyor 29 varies as a function of changes in the thickness (height) of fibrous material in the respective portion of the second path. Such portion is located slightly ahead of a standard surplus removing or trimming device 76 and downstream of the material-receiving or stream building zone of the second path.

FIG. 4 shows the operative position of the support 39b and section 24a by broken lines. When the support 39b is moved to the solid-line position of FIG. 4, the scraper 72 registers with the channel 37 and is caused to enter the channel and to thereupon advance toward the trimming device 76 as soon as the motor 73 is started by the control circuit in response to a signal from the transducer 77b of the monitoring device 77, i.e., as soon as the device 77 detects an irregularity in the second stream.

FIG. 5 shows that the frame 80 of the apparatus is provided with guide means in the form of parallel dovetailed grooves for complementary tongues 74 of the support 39b. Such tongues and grooves ensure predictable movements of the support 39b between the solid-line and broken-line positions of FIG. 4. The means for moving the support 39b between such positions can include a drive (57) of the type shown in FIG. 2. The section 24a exposes the inlet of a third path for successive increments of the flow of fibrous material when the support 39b begins to move toward (or when the support 39b completes the movement to) the solid-line position of FIG. 4.

It will be noted that the monitoring device or devices need not necessarily be installed in or adjacent the channel 37 and/or in one of the walls 38, 38a constituting or forming part of the channel. Thus, a monitoring device (note the monitoring device 77 of FIG. 5) can be installed in immediate or close proximity to the surplus removing or trimming device 76. It is further possible to use two or more monitoring devices (e.g., the monitoring device 77 adjacent the trimming device 76 and the monitoring device 53 (note FIG. 4) or 63 at or in the wall 38a of the channel 37) to even more reliably detect an irregularity at the very location where the irregularity develops.

The monitoring device 77 of FIG. 5 can comprise a source 77a which emits infrared light, visible light or any other suitable form of radiation, e.g., beta rays. In the latter instance, the transducer 77b can constitute an ionization chamber.

As already mentioned above, the control circuit 54 is preferably designed to immediately return the support 39, 39a or 39b to operative position as soon as the irregularity has been detected and eliminated, i.e., as soon as the second path is again free to receive successive increments of a flow 26 of fibrous material from the section or transferring means 24a of the material advancing member 24. The control circuit 54 also restarts the drive 56 for the carded wheel 3 and picker roller 4 of the material withdrawing and supplying device 2 so that the distributor can proceed with the gathering of a flow 26 which is advanced into the channel 37. Automatic starting of the drive 56 and automatic resetting of the support 39, 39a or 39b to operative position is desirable and advantageous in a modern cigarette maker or a like machine because it is not necessary to rely on an operator to restart the apparatus practically upon detection and elimination of an irregularity in the stream of fibrous material.

An important advantage of the improved method and apparatus is that an irregularity in the stream 126 of fibrous material cannot be aggravated to thus contribute to complexity of elimination of such irregularity. This is due to the fact that the irregularities can be detected during any desired (particularly very early) stage of development by one or more automatic monitoring devices, and that the necessary undertakings to eliminate a detected irregularity can be carried out automatically and instantaneously. Thus, the control circuit 54 can initiate a diversion of fibrous material which forms the flow 26 into a third path which bypasses the second path, such control circuit can simultaneously interrupt further delivery of fibrous material to the material advancing member 24, and the control circuit can immediately initiate removal of the stream 126 from the second path. Still further, the control circuit 54 can automatically reset the transferring means 24a and restart the drive 56 to thus ensure that the making of the stream 126 can be resumed as soon as the irregularity is eliminated. The control circuit 54 can ensure rapid and complete removal of fibrous material from the second path in several ways and even in two different ways in a simultaneous operation. Thus, and referring again to FIG. 2, the control circuit 54 can adjust the valve 32 to seal the outlet of the suction chamber 31 from the intake of the suction generating device 33, and the control circuit 54 can simultaneously initiate admission of compressed air from the source 49 of FIG. 1 into the nozzle 62 as soon as the support 39a leaves the broken-line position or not later than when the support 39a reaches the solid-line position. If necessary, the control circuit 54 can simultaneously initiate admission of compressed air into the suction chamber 31 (note the connection 149 in FIG. 1) to ensure an even more rapid and an even more reliable removal of fibrous material from the second path.

The monitoring device or devices can be designed to detect irregularities in the form of aforediscussed stoppers as well as other irregularities, e.g., the failure of the stream 126 to advance at the speed of the conveyor 29. Moreover, the monitoring device or devices can be designed and mounted to detect gaps in the stream 126, i.e., any irregularities which would adversely affect the quality of the trimmed or equalized stream and would necessitate segregation of corresponding rod-shaped articles from satisfactory articles. It is further within the purview of the invention to install discrete monitoring devices at or in each of the walls 38, 38a as well as in the region of the trimming device 76.

It is equally possible to dispense with pneumatic, mechanical and/or other material removing means and to rely exclusively on gravity (by disconnecting the suction chamber 31 from the suction generating device 33) in order to effect removal of fibrous material from the second path in response to automatic detection of an irregularity. An operator can stand by to manually remove remnants of fibrous material if a sealing of the suction chamber 31 from the suction generating device 33 does not suffice to ensure rapid and complete removal of fibrous material from the second path.

The connection between the control circuit 54 and the drive 56 ensures that the quantity of fibrous material which must be returned into the magazine of the distributor is reduced to a minimum. This reduces the likelihood of undesirable comminution of fibrous material (e.g., shredded tobacco leaf laminae). The magazine which receives returned fibrous material can be place into immediate proximity of the aforediscussed conveyor (e.g., an elevator conveyor) which delivers fibrous material into the duct 1 of the distributor shown in FIG. 1.

A further important advantage of the improved method and apparatus is that the elimination of irregularities can be carried out in a simple, space-saving and efficient manner without affecting the quality of fibrous material and with a minimal delay to thus ensure that the making of the stream 126 can be resumed with a delay which is absolutely necessary to remove the irregularity, e.g., an excessive accumulation of fibrous material in the second path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making a stream of fibrous material, such as a tobacco stream, for conversion into the filler of a cigarette rod, comprising the steps of advancing a flow of loose fibrous material along a first path having a discharge end; transferring successive increments of the advancing flow into a second path and conveying the transferred fibrous material along the second path in the form of a stream; monitoring the stream for the presence or irregularities including stoppage of the stream and excessive accumulations of fibrous material in the stream; ;and interrupting the transfer of of fibrous material into the second path in response to detection of irregularities, including admitting fibrous material from the discharge end of the first path into a third path which bypasses the second path.

2. The method of claim 1, wherein said conveying step includes transferring fibrous material onto an endless conveyor and one of said paths extends substantially transversely of another of said paths.

3. The method of claim 1, wherein said interrupting step comprises admitting fibrous material from the first path into a third path which bypasses the second path.

4. The method of claim 1, further comprising the steps of removing fibrous material from the second path on detection of irregularities in the stream and thereafter resuming the transfer of fibrous material from the first path into the second path.

5. A method of making a stream of fibrous material, such as a tobacco stream for conversion into the filler of a cigarette rod, comprising the steps of advancing a flow of loose fibrous material along a first path; transferring successive increments of the advancing flow into a second path and conveying the transferred fibrous material along the second path in the form of a stream, said first path having an outlet which is adjacent a material-receiving portion of said second path during transfer of fibrous material into said second path; monitoring the stream for the presence of irregularities including stoppage of the stream and excessive accumulations of fibrous material in the stream; and interrupting the transfer of fibrous material into the second path in response to detection of irregularities, including changing the positions of the outlet and the material-receiving portion relative to each other so that fibrous material issuing from the outlet bypasses the material-receiving portion of the second path.

6. The method of claim 5, wherein said changing step includes moving the outlet of the first path relative to the second path.

7. The method of claim 5, further comprising the step of admitting fibrous material from the outlet of the first path into a third path in response to completion of said changing step.

8. A method of making a stream of fibrous material, such as a tobacco stream for conversion into the filler of a cigarette rod, comprising the steps of advancing a flow of loose fibrous material along a first path; transferring successive increments of the advancing flow into a second path and conveying the transferred fibrous material along the second path in the form of a stream; monitoring the stream for the presence of irregularities including stoppage of the stream and excessive accumulations of fibrous material in the stream; interrupting the transfer of fibrous material into the second path in response to detection of irregularities; and admitting fibrous material from the first path into storage in response to said interrupting step.

9. A method of making a stream of fibrous material, such as a tobacco stream for conversion into the filler of a cigarette rod, comprising the steps of advancing a flow of loose fibrous material along a first path; transferring successive increments of the advancing flow into a second path and conveying the transferred fibrous material along the second path in the form of a steam; monitoring the stream for the presence of irregularities including stoppage of the stream and excessive accumulations of fibrous material in the stream, said second path including a portion which receives fibrous material from said first path in the absence of irregularities; interrupting the transfer of fibrous material into the second path in response to detection of irregularities; and removing at least the major part of the stream from said material receiving portion of the second path on detection of irregularities in the stream.

10. A method of making a stream of fibrous material, such as a tobacco stream for conversion into the filler of a cigarette rod, comprising the steps of advancing a flow of loose fibrous material along a first path; transferring successive increments of the advancing flow into a second path and conveying the transferred fibrous material along the second path in the form of a stream, said conveying step including transporting fibrous material by an endless conveyor; monitoring the stream for the presence of irregularities including stoppage of the stream and excessive accumulations of fibrous material in the stream; interrupting the transfer of fibrous material into the second path in response to detection of irregularities; and removing at least the major part of the stream from the conveyor on detection of irregularities in the stream.

11. The method of claim 10, wherein said removing step includes mechanically removing fibrous material from the conveyor.

12. The method of claim 10, wherein said removing step includes pneumatically removing fibrous material from the conveyor.

13. A method of making a stream of fibrous material, such as a tobacco stream for conversion into the filler of a cigarette rod, comprising the steps of advancing a flow of loose fibrous material along a first path; transferring successive increments of the advancing flow into a second path and conveying the transferred fibrous material along the second path in the form of a stream, said conveying step including delivering fibrous material onto an endless foreminous conveyor and pneumatically retaining the delivered fibrous material on the conveyor; monitoring the stream for the presence of irregularities including stoppage of the stream and excessive accumulations of fibrous material in the stream; interrupting the transfer of fibrous material into the second path in response to detection of irregularities; and interrupting said retaining step on detection of irregularities in the stream.

14. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; and interrupting means operative to interrupt the transfer of fibrous material from the first path into the second path, said interrupting means including means for changing the positions of said conveyor means and said transferring means relative to each other.

15. The apparatus of claim 14, wherein said changing means includes means for moving said transferring means transversely of said second path to and from a predetermined position in which fibrous material leaving said first path is prevented form entering said second path.

16. The apparatus of claim 15, further comprising means for accepting fibrous material from said first path in said predetermined position of said transferring means.

17. The apparatus of claim 15, wherein said moving means includes means for pivoting said transferring means to and from said predetermined position.

18. The apparatus of claim 15, wherein said moving means includes means for imparting to said transferring means a substantially translatory movement to and from said predetermined position.

19. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; interrupting means operative to interrupt the transfer of fibrous material from the first path into the second path; and means for monitoring said second path for irregularities of the stream and for generating signals in response to detection of irregularities including the presence of excessive quantities of fibrous material in said second path such as could result in clogging of the second path.

20. The apparatus of claim 19, further comprising means for operating said interrupting means in response to said signals.

21. The apparatus of claim 19, wherein said monitoring means includes means for monitoring the quantity of fibrous material in successive increments of the stream and for generating signals when the quantity of fibrous material exceeds a preselected value.

22. The apparatus of claim 21, wherein said interrupting means includes means for moving said transferring means to and from a predetermine position in which fibrous material leaving said first path bypasses said second path, and further comprising means for operating said moving means in response to said signals to move said transferring means to said predetermined position.

23. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path, said conveying means including an endless conveyor and a channel for said conveyor adjacent said transferring means, said channel having a first wall at one side of the second path and a second wall at the other side of the second path, said transferring means being arranged to transfer fibrous material into said channel in a direction toward one of said walls; interrupting means operative to interrupt the transfer of fibrous material from the first path into the second path; and means for monitoring the second path for irregularities of the stream at the other of said walls including the presence of excessive quantities of fibrous material such as could result in clogging of the second path.

24. The apparatus of claim 23, wherein said monitoring means includes at least one photoelectronic transducer.

25. The apparatus of claim 23, wherein said monitoring means is provided in said other wall.

26. The apparatus of claim 25, wherein said monitoring means includes an electric detector.

27. The apparatus of claim 25, wherein said monitoring means includes an electromagnetic detector.

28. The apparatus of claim 25, wherein said monitoring means includes an optical detector.

29. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; interrupting means operative to interrupt the transfer of fibrous material from the first path into the second path; and means for monitoring the second path for irregularities of the stream and for generating signals in response to detection of irregularities including the presence of excessive quantities of fibrous material such as could cause clogging of the second path, said monitoring means including means for directing at least one beam of radiation across said second path.

30. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; interrupting means operative to interrupt the transfer of fibrous material from the first path into the second path; means for monitoring the second path for the presence of irregularities in the stream and for generating signals in response to detection of irregularities; and means for effecting removal of at least the major part of the stream from the second path.

31. The apparatus of claim 30, wherein said interrupting means includes means for moving said transferring means with reference to said conveying means in response to said signals.

32. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; interrupting means operative to interrupt the transfer of fibrous material from the first path into the second path, said interrupting means comprising a support for said transferring means and means for moving said support between a first position in which said transferring means directs fibrous material from the first path into the second path and a second position in which fibrous material leaving said first path bypasses said second path; and means for removing fibrous material from said second path in the second position of said support, said removing means being provided on said support.

33. The apparatus of claim 32, wherein said support has a side facing away from said transferring means and said removing means is provided at said side of said support.

34. The apparatus of claim 32, wherein said removing means includes means for directing at least one jet of a compressed gaseous fluid into said second path.

35. The apparatus of claim 32, wherein said transferring means forms an integral part of said support.

36. The apparatus of claim 32, wherein said removing means includes a mechanical material removing device.

37. the apparatus of claim 36, wherein said removing means further comprises means for moving said material removing device along said second path.

38. The apparatus of claim 37, wherein said conveying means comprises an endless conveyor a portion of which defines said second path, and further comprising a channel having walls flanking said portion of said conveyor, said moving means including means for moving said material removing device in said channel and along said portion of said conveyor.

39. Apparatus for making a stream of fibrous material, such as a tobacco stream for conversion into the filler of a cigarette rod, comprising means for advancing a flow of loose fibrous material along a first path; means for conveying successive increments of the flow along a second path in the form of a stream, said advancing means including means for transferring successive increments of the flow into said second path; a magazine for fibrous material; and interrupting means operative to interrupt the transfer of fibrous material from the first path into the second path, said interrupting means including means for at least temporarily directing fibrous material from said first path into said magazine.

40. The apparatus of claim 39, wherein said directing means includes at least one conveyor arranged to transport fibrous material into said magazine and means for changing the position of said transferring means relative to said conveying means so that the transferring means effects the delivery of fibrous material from the first path to said conveyor.

41. Apparatus for making a stream of fibrous material, such as a tobacco stream for conversion into the filler of a cigarette rod, comprising means for advancing a flow of loose fibrous material along a first path; means for supplying fibrous material toward said first path; drive means for said supplying means; means for conveying successive increments of the flow along a second path in the form of a stream, said advancing means including means for transferring successive increments of the flow into said second path; interrupting means operative to interrupt the transfer of fibrous material from the first path into the second path; means for monitoring said second path for irregularities of the stream and for generating signals on detection of irregularities; and control means for arresting said drive means in response to said signals.

42. The apparatus of claim 41, further comprising means for effecting removal of fibrous material from the second path in response to said signals, said control means including means for restarting said drive means upon removal of fibrous material from said second path.

* * * * *